United States Patent [19]

Kriegel

[11] Patent Number: 4,733,498

[45] Date of Patent: Mar. 29, 1988

[54] FAST FOOD SERVICE ACCESS WINDOW WITH SEGMENTED PUSH-BAR

[75] Inventor: Carl P. Kriegel, Houston, Tex.

[73] Assignee: M.C.E. Window, Inc., Houston, Tex.

[21] Appl. No.: 811,887

[22] Filed: Dec. 20, 1985

[51] Int. Cl.[4] ..... E05C 7/06

[52] U.S. Cl. ..... 49/110; 49/114; 49/115; 49/333

[58] Field of Search ..... 49/104–112, 49/114, 115, 333, 334, 261

[56] References Cited

U.S. PATENT DOCUMENTS

| | | | |
|---|---|---|---|
| 1,975,953 | 10/1934 | Keys | 49/333 X |
| 3,940,887 | 3/1976 | Slaybaugh | 49/334 X |
| 4,411,102 | 10/1983 | Radek | 49/110 |
| 4,442,630 | 4/1984 | Radek | 49/104 X |

*Primary Examiner*—Kenneth J. Dorner
*Assistant Examiner*—G. A. Anderson
*Attorney, Agent, or Firm*—J. David Cabello

[57] ABSTRACT

An access window for use in fast food establishments and other similar drive-thru business establishments is disclosed. The window broadly comprises an elastic operating mechanism, two planar window members and a segmented articulated push-bar operator which is pushed to open the access windows. The push-bar operator can be locked in the open position. Upon releasing and/or unlocking the operator push-bar assembly the access window returns to its closed position by means of a closer bias member. The access window also comprises a locked window bias member which absorbs the pushing action on the operator push-bar, in the event the access window is latched shut, without damaging the access window and further without damaging the operating mechanism. The operating mechanism employs an off-center groove in the rotor located in the bottom hinge assembly which serves to produce a greater initial opening torque than the opening torque at the end of the opening cycle and conversely produces a greater closing torque at the end of the closing cycle.

17 Claims, 11 Drawing Figures

Fig.4
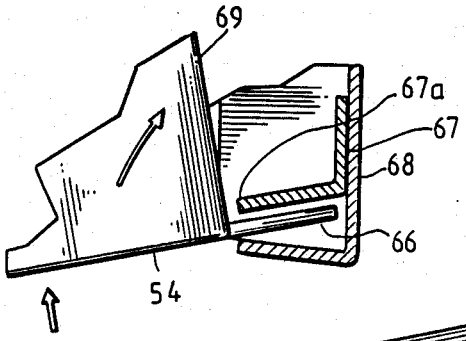
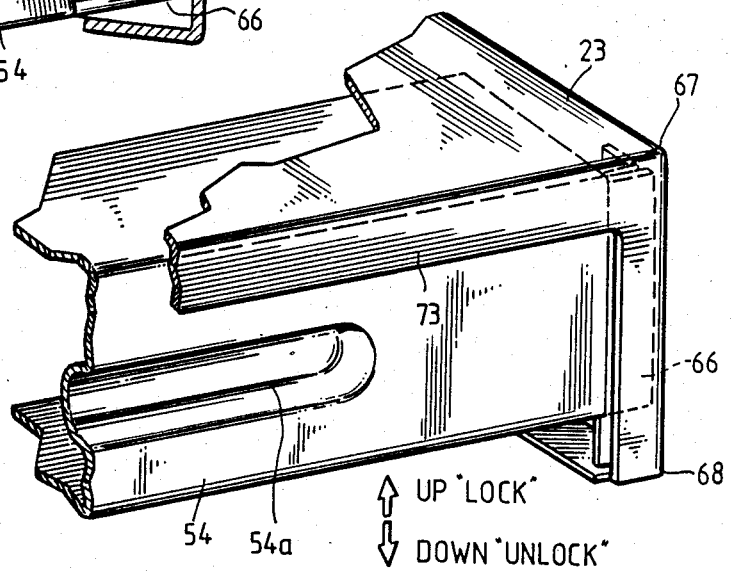
Fig.5
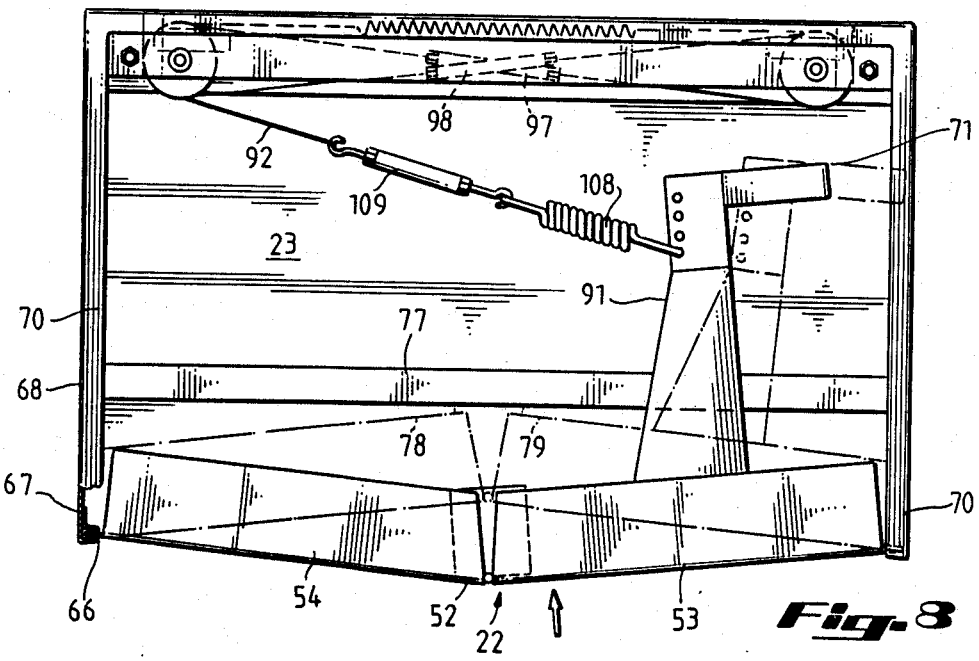
Fig.8

FAST FOOD SERVICE ACCESS WINDOW WITH SEGMENTED PUSH-BAR

BACKGROUND OF THE INVENTION

1. Field of the Invention

This invention pertains to access windows and similar equipment and more particularly to access windows for drive-through fast food service.

The invention especially relates to access windows typically installed on the side of a building adjacent a driveway to facilitate business transactions between a clerk and a customer. The most common use of such windows is for fast-food drive-in establishments.

In a typical commercial environment a drive-in access window must easily permit the clerk to transact business with a customer and yet provide the necessary isolation between the outside environment and the inside environment to satisfy health code requirements.

2. Brief Description of the Prior Art

Prior art access windows typically employ rigid inflexible members on the window openers such as those illustrated and described in U.S. Pat. No. 4,411,102. The windows may be actuated solely be manual force or by electrical motors triggered by such force. In both cases, however, the mechanisms involved rely on mechanisms which transmit forces with essentially no give or flexibility.

The prior art also describes an attempt to employ rigid members in combination with a rubber-toothed transmission belt. An example of such a system is described in U.S. Pat. No. 4,442,630.

The manually-operated service windows depicted in prior art referred to above typically make use of a plunger head with limited surface area for contact by a human operator. The use of such a plunger head in combination with other mechanical aspects of the prior art has resulted in a window which requires substantial force to open, and which requires a significant amount of force to retain it in the open position. In the case of a purely mechanical system, the window requires considerable effort on the part of a clerk to open a window and keep it open.

SUMMARY OF THE INVENTION

The present invention meets the above-mentioned disadvantages by providing an access window which employs a push-bar operator with a substantial surface area to permit a person to push on the surface area with any part of the person's torso. The invention is further characterized by a mechanism which enables a window to be opened with little force or discomfort. The window is capable of opening smoothly without the need of electrical power.

The preferred embodiment of the apparatus comprises a pair of hinged windows with a common unhinged midpoint where they seal against each other. The windows are hinged on vertical axes, and preferably employ an antifriction bearing at the top of each hinge and a machined rotor at the bottom of each hinge. The rotors are coupled to the push-bar operator by means of an elastic coupling system which is adjustable and returns the windows to a closed position when the push-bar is released. In a preferred form, the coupling system incorporates a "locked-window" bias member which absorbs operation of the push-bar whenever the window is locked and averts damaging the overall system.

The coupling system also preferably includes a feature which provides a uniform push-bar resistance as the windows are operated between a fully open and a fully closed position. The feature in a preferred form employs an off-center radius groove on the rotors attached to the lower hinges of the windows.

In a general sense, the present invention resides in a fast food access service window which employs an operator push-bar that can be pushed by any part of a clerk's torso with greatly reduced force and discomfort.

This bar preferably is capable of being easily locked in the open position and then quickly released to permit the window to close. The bar preferably is also capable of absorbing a force applied to open a window when the window is locked shut, without damaging the window or its operator.

The various features and principles of the invention will become obvious to those skilled in the art upon review of the detailed description in conjunction with the appended drawings and claims.

BRIEF DESCRIPTION OF THE DRAWINGS

FIG. 4 is a cross-section taken along line 4—4 of FIG. 3 illustrating a top view of the horizontal operator bar outboard-end hinge.

FIG. 5 is a partial perspective view of the horizontal operator bar in the "locked-open" position.

FIG. 8 is a bottom view of the access window operator illustrating the horizontal push-bar in access window "open" (in phantom) and access window "closed" positions.

DESCRIPTION OF THE PREFERRED EMBODIMENTS

Figure 1:
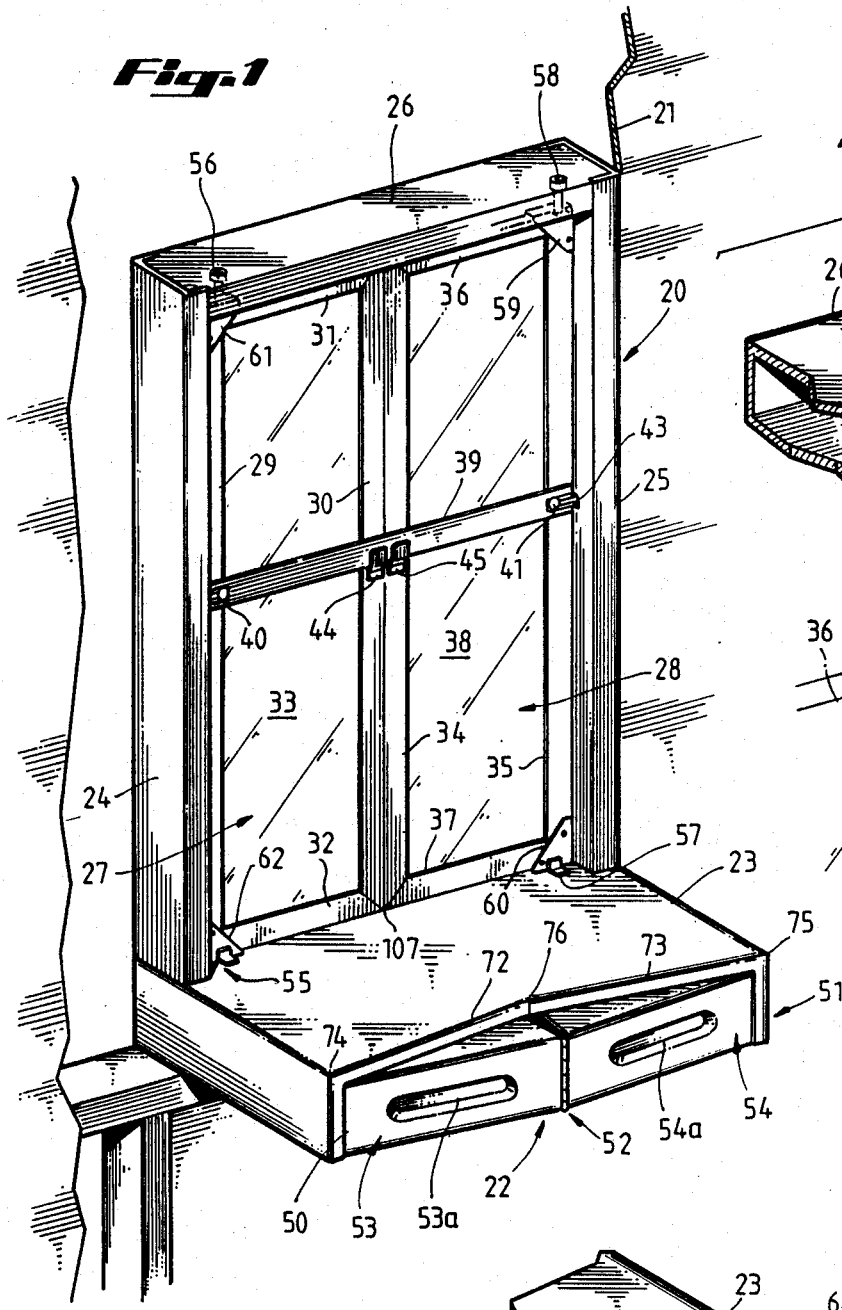
FIG. 1 is a perspective view of one embodiment of an access service window located in a wall.

FIG. 1 illustrates an access window 20 attached to a wall 21. Very broadly, the external components of the window include the horizontal operator push-bar 22, the horizontal service shelf 23, the vertical access window frame members 24 and 25, the top horizontal access window frame member 26, left pivoting or swinging window member 27, and right pivoting or swinging window member 28.

Left swinging planar surface or window member 27 comprises a frame with vertical frame members 29 and 30, top frame member 31 and bottom frame member 32. Frame members 29, 30, 31, 32 describe the outer perimeter of a window pane 33 which in the preferred embodiment is glass.

In a similar manner right swinging planar surface or window member 28 comprises vertical frame members 34 and 35, top frame member 36 and bottom frame member 37. Frame members 34, 35, 36 and 37 likewise form the outer perimeter of window pane 38.

In a preferred embodiment of the present invention frame members 29 and 31 are joined together by mitered joints at 45° angles. Similarly, adjacent frame members are likewise joined by mitered joints.

Vertical frame members 29 and 35 provide for offset vertical swinging axes of window members 27 and 28, respectively. In a preferred embodiment window members 27 and 28 swing outward pivoting about their vertical swinging axes. The window members 27 and 28 meet at the access window centerline, as vertical frame members 30 and 34 come into contact when the window is closed.

Alternatively, window members 27 and 28 may be configured to swing inward pivoting about the same vertical swinging axes.

Also illustrated in FIG. 1 is a horizontal window latching bar 39, sliding latch mechanisms 40 and 41 and latching bar slots 44 and 45. Latching bar 39 is used to latch or lock the access window in the closed position. To latch the window in the closed position horizontal bar 39 is first placed in latch bar slots 44 and 45. Sliding latch bars 40 and 41 are then moved slidably outward into suitable slots, holes or like receptacles 42 (not shown) and 43.

FIG. 1 also illustrates a segmented horizontal push-bar 22 which is hinged at outboard ends 50 and 51. The segmented push-bar 22 is also hinged or articulated at piano hinge 52 between the outboard ends 50 and 51. In a preferred embodiment, piano hinge 52 is located equidistant from the outboard ends 50 and 51.

Horizontal push-bar 52 consists of two horizontal segments or members 53 and 54. Horizontal members 53 and 54 have hand holds **53*a* and 54*a***, respectively.

Swinging window member 27 pivots about pivot points 55 and 56. In a similar manner right window member 28 pivots about pivot points 57 and 58. A line drawn between pivot points 55 and 56 forms an imaginary vertical pivot axis which is hereinafter referred to as the vertical pivot axis. In a preferred embodiment, the vertical pivot axis is offset from frame members 29 and 35 as shown in FIG. 2.

Figure 2:
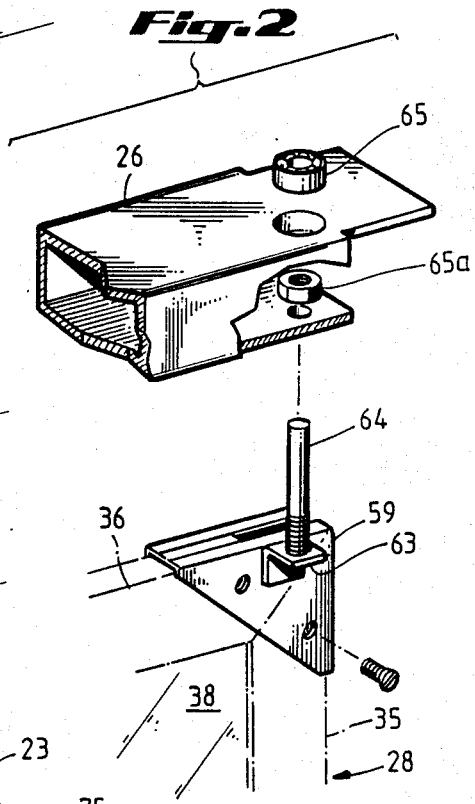
FIG. 2 is a detailed, exploded, partially cutaway perspective view of one of the top hinge posts of one of the window members.

Referring to FIG. 2, an exploded view of right swinging window member 28 illustrates the mitered joint of top horizontal frame member 36 with right vertical frame member 28, top window member attachment bracket 59, hinge post bracket 63, hinge post 64 and top window frame member 26. Window member attachment bracket 59 is attached to window frame members 35 and 36 by means of screws or other similar devices.

A hinge post bracket 63 is attached to the window corner bracket 59 by brazing or other suitable means. The top hinge post 64 is similarly brazed to the hinge post bracket. The centerline of hinge post 64 is the centerline of vertical pivot axis between pivot points 57 and 58.

Hinge post 64 is inserted through an antifriction device 65 such as a roller bearing. Hinge post 64 is held in its vertical position by means of nut **65*a* or other suitable means. Bearing 65** is retained in position by a bearing receptacle fabricated from flat bar stock or in any other suitable manner.

It is to be understood that the top of window member 27 is hinged in a manner similar to that described for window member 28.

Figure 3:
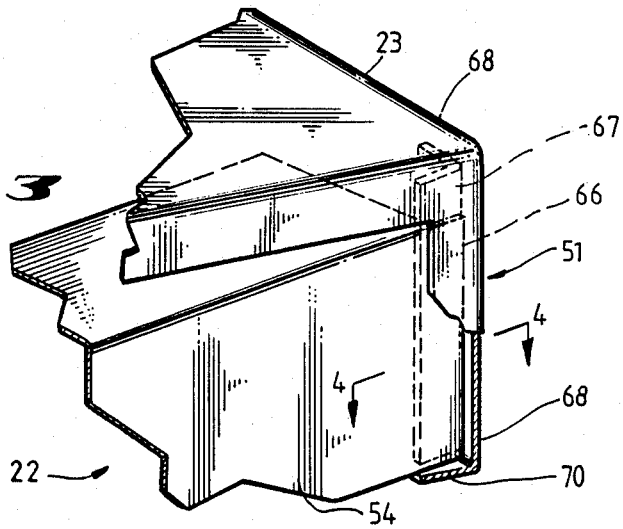
FIG. 3 is a detailed, perspective, partially phantom view of the horizontal operator bar outboard-end hinge.

Referring to FIG. 3, the right outboard hinge 51 of the horizontal operator push-bar 22 is illustrated in detail. Push-bar section 54 has a protruding hinge member 66 which is restrained by angle member 67. Angle member 67 is brazed or welded to the service shelf vertical wall 68. Service shelf vertical wall 68 is attached to the horizontal service shelf 23.

Horizontal tab 70 is also attached to service shelf vertical wall 68 and limits the downward travel of the push-bar section 54 and consequently of the segmented horizontal push-bar 22. The hinge arrangement of push-bar section 53 is similar to that illustrated for push-bar section 54.

Referring to FIG. 4, a top view of the above-described push-bar hinge arrangement is illustrated. The top view is taken along line 4—4 of FIG. 3. As a force pushes on push-bar section 54 as shown by the straight arrow, push-bar section 54 moves inward with a rotating clockwise motion (as illustrated by the rotational arrow). When the push-bar member 54 has been pushed sufficiently inward, i.e., sufficient to open the access window, the rotating motion is partially arrested by contact of edge **67*a* of angle member 67 with the side wall 69 of push-bar member 54. The side wall of push-bar member 53 also restrains push-bar member 53** in a similar fashion.

Inward motion of push-bar 22 is also partially arrested by travel stop 71 (illustrated in FIG. 8). The design of horizontal shelf 23 likewise aids in arresting the inward motion of push-bar 22. Referring to FIG. 1, the horizontal shelf front surface members or walls 72 and 73 immediately above push-bar 22 recede from points 74 and 75 towards midpoint 76. The members 72 and 73 form in essence an outward-facing V-shaped member. As push-bar 22 flexes inward, the push-bar changes configuration from an inward-facing V-shaped member to an outward-facing V-shaped member. Push-bar 22 travel in essence stops when the push-bar 22 surfaces are flush with the vertical members 72 and 73. Thus, a person operating the access window with the lower part of the torso by pushing on the push-bar 22 will ultimately feel the sensation of relatively rigid members 72 and 73, and thereby know without visual inspection that the access window should be fully open.

The push-bar 22 can be locked to maintain the access window in the open position. This is accomplished by pushing push-bar 22 inwardly past front surface members or walls 72 and 73 (see FIGS. 1 and 5), then sliding push-bar 22 upward behind the members 72 and 73. Sliding push-bar 22 upward is most easily accomplished by inserting one's fingertips in hand-holds **53*a* and 54*b* and gently urging push-bar 22 upward behind the surface members or walls 72 and 73**.

To unlock push-bar 22 a person must push the push-bar 22 inward slightly and then by inserting the fingertips in hand holds **53*a* and 54*b* urge the push-bar 22 downward. Prior to unlocking, as push-bar 22 is pushed inward excessive inward motion is restrained by travel stop 71 (illustrated in FIG. 8). Referring to FIG. 8, as the horizontal push-bar 22 is pushed inwardly (as shown by the arrow), push-bar members or segments 53 and 54 flex inwardly. The inward flexing is permitted by the hinge arrangement depicted in FIG. 4, as well as piano hinge 52. As push-bar 22 flexes inwardly, push-bar travel stop 71 comes to rest on vertical wall 70** and restrains further inward travel.

Cross member 77 is rigidly affixed to the underside of horizontal shelf 23 to provide further support and rigidity to horizontal serving shelf 23.

Figure 6:
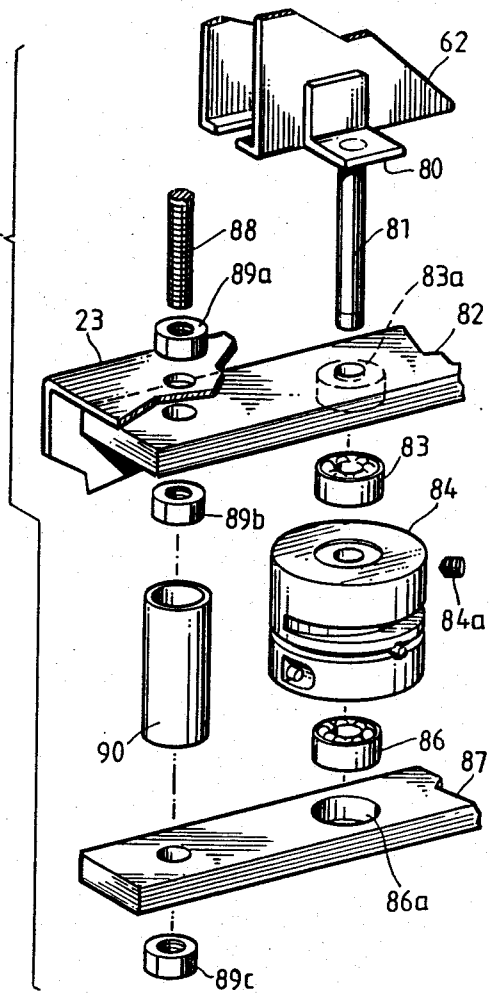
FIG. 6 is an exploded view of the bottom hinge post of one of the window members.

Referring to FIG. 6, the lower hinge of window members 27 is illustrated in detail; the lower hinge for window member 28 is similar.

Left window bottom corner bracket 62 is attached to the vertical frame member 29 and horizontal frame member 32 using screws or other suitable means. A bottom hinge post bracket 80 is attached to the corner bracket 62 by means of brazing or other suitable means. A hinge post 81 is similarly attached to hinge post bracket 80.

Hinge post 81 is inserted through horizontal shelf 23, bracket 82, an upper antifriction member 83, rotor 84 and a lower antifriction member 86. Antifriction member 83 in a preferred embodiment is a roller bearing which is inserted in a bearing receptacle 83*a* machined out of bracket 82. In a similar manner, bearing receptacle 86*a*for bearing 86 is machined out of lower bracket 87. The lower hinge assembly is held together by means of threaded stud 88, nuts 89*a* and 89*b*, spacer 90 and nut 89*c*. Spacer 90 is interdisposed between brackets 82 and 87 to prevent the compressive forces of nuts 89*a* and 89*c* from interfering with the rotation of rotor 84.

Brackets 82 and 87 are mounted below shelf 23 and are held in place by securing brackets 82 and 87 to shelf 23 by means of threaded stud 88, nuts 89*a*, 89*b*, spacer 90 and nut 89*c*. Threaded studs 88 are long enough to protrude through horizontal shelf 23 to secure window frame members 24 and 25 in the vertical position.

Figure 7:
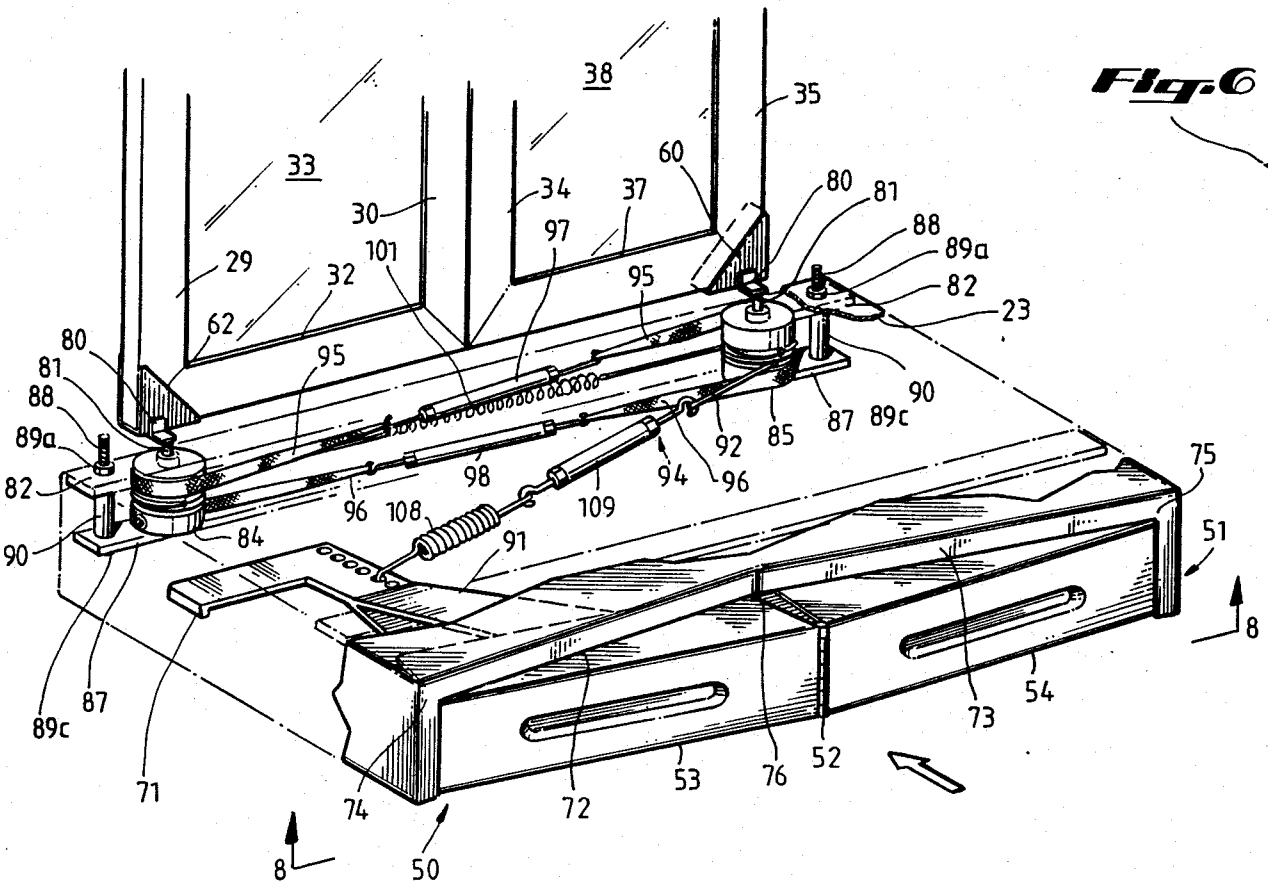
FIG. 7 is a perspective top view of the access window with the top-shelf cut away to illustrate the operator linkage with the access window in the closed position.

Rotor 84 is attached to hinge post 81 by means of set screw 84*a* (see FIG. 7). Set screw 84*a* is screwed into hinge post 81. Rotor 85 is attached to its respective hinge post in a similar manner.

Various aspects of the elastic and flexible linkage which interconnects push-bar 22 to window rotors 84 and 85 are illustrated in FIGS. 6 through 11. Push-bar bracket 91 is rigidly attached to push-bar segment 53. Push-bar bracket 91 is operatively attached to the right hand rotor 85 by means of a string, typically a 640 lb. test No. 72 nylon string 92. The string 92 is wrapped about groove 93 of rotor 85. Rotor groove 93 is a concentric groove machined out of the cylindrical rotor 85. The groove 93 is high enough to accommodate string 92 and deep enough to permit string 92 to fit within groove 93 without protruding out of the groove.

String 92 is wrapped around rotor 85 in a counterclockwise fashion (from top of rotor 85 looking down). String 92 is anchored in groove 93 by means of a knot in string 92, or other suitable means, in a surface machined to hold the knot without slipping. This orientation permits rotor 85 to turn clockwise as push-bar bracket 91 moves in the direction illustrated by the arrow (see FIG. 9). Push-bar-bracket 91 moves in the direction illustrated by the arrow when push-bar 22 is moved inward.

Figure 9:
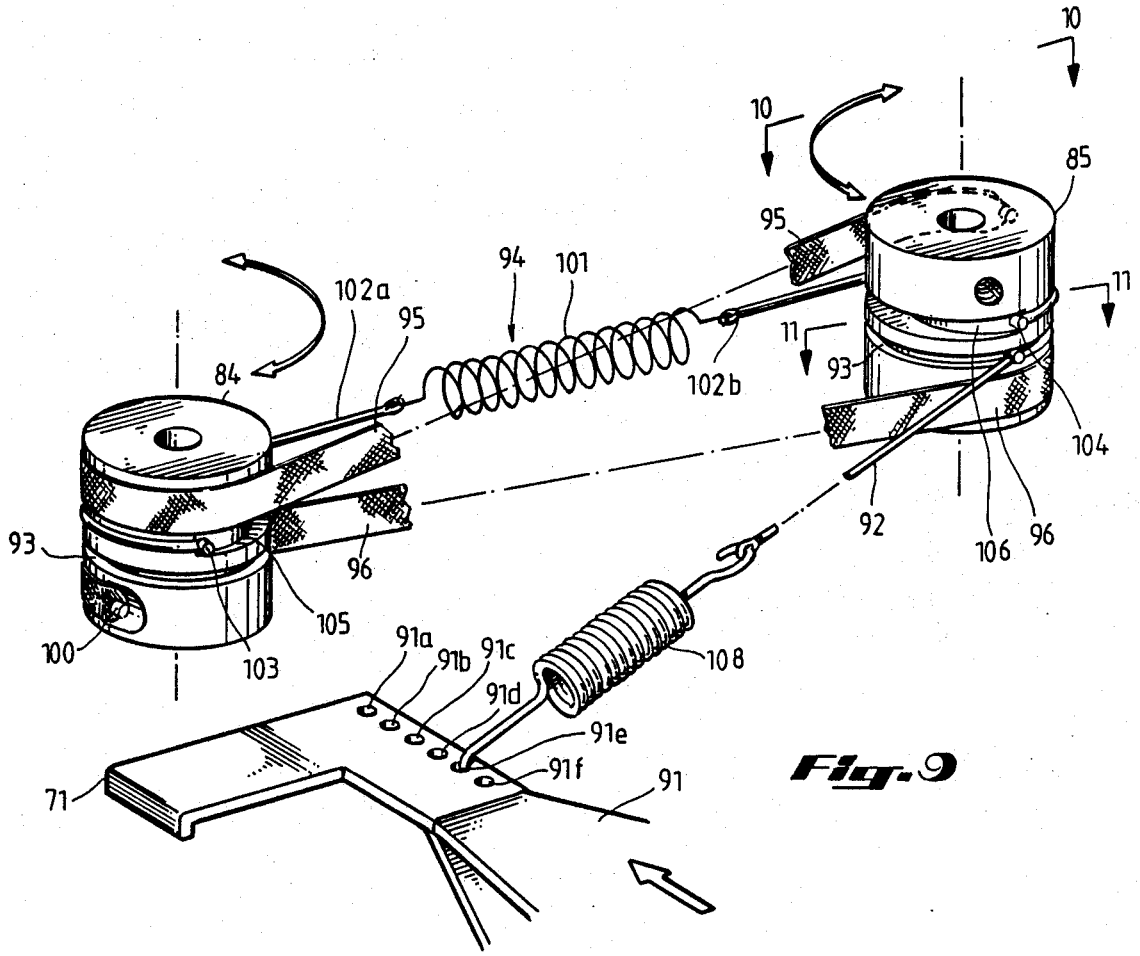
FIG. 9 is a partial detailed development of the access window operator.

Rotors 84 and 85 are interconnected by means of a flexible linkage 94. Flexible and elastic linkage 94 comprises counter rotation links 95 and 96. Referring to FIG. 9 counter rotation link 95 is wrapped around the backside of rotor 85 and around the front side of rotor 84. In a similar manner counter rotation link 96 is wrapped around the backside of rotor 84 and around the front side of rotor 85. The counter rotation links 95 and 96 cause rotor 84 to rotate in a counterclockwise direction, whenever rotor 85 rotates in a clockwise direction. They further cause rotor 84 to rotate in a clockwise direction, whenever rotor 85 rotates in a counterclockwise direction. Equal and equidistant rotation is accomplished by adjusting turnbuckles 97 and 98. (See FIG. 7). Turnbuckles 97 and 98 are adjusted in a manner such that the length of interconnecting link 95 is equal to the length of interconnecting link 96.

In a preferred embodiment, interconnecting linkages 95 and 96 are constructed of 10 strands of 80 lb. No. 9 nylon fishing line. The 10 strands are woven on a loom into a flat band. The flat band in the preferred embodiment is very pliable and flexible and provides a significant number of window operations without breakage and without deterioration of adjustment or operation.

Figure 10:
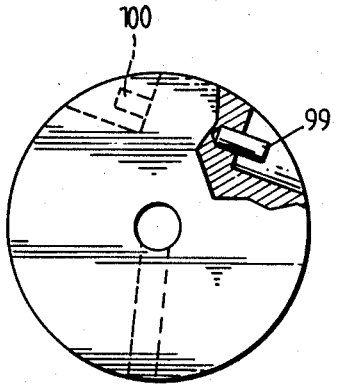
FIG. 10 is a top view of one of the access window rotors taken along line 10—10 of FIG. 9.

Counter rotation link 95 is anchored to rotor 84 at anchor point 99 (shown in FIG. 10). Counter rotation link 96 is anchored to rotor 84 at anchor point 100 (shown in FIGS. 9 and 10). Counter rotation links 95 and 96 are anchored to rotor 85 in a similar fashion. The counter rotation links 95 and 96 rotate about the outer peripheries of rotors 84 and 85.

To close the window members 27 and 28 upon release of push-bar 22, window closer bias member 101 interconnects rotors 84 and 85 by means of bias member linkages 102*a* and 102*b*. Window closer bias member 101 in the preferred embodiment is a spring. Bias member linkages 102*a* and 102*b* are 150 lb. test No. 36 nylon string. One end of bias member linkage 102*a* is attached to anchor post 103 on rotor 84, and the other end is attached to bias member 101. Bias member linkage 102*b* is attached at one end to bias member 101 and at its other end to anchor post 104 of rotor 85.

Bias member linkage 102*a* fits in bias linkage groove 105 when the access window is open. In a similar manner bias member 102*b* fits in bias linkage groove 106 when the access window is open.

When the access window is closed the bias member linkage 102*b* does not fit in bias linkage groove 106 but rather on the outer periphery 106*a*, of rotor 85. Outer periphery 106*a* exists because of the off-center groove 106 which is cut in the cylindrical rotor 85.

In a similar manner, bias linkage member 102*a* fits on the outer periphery of rotor 84 whenever the access window is closed.

Figure 11:
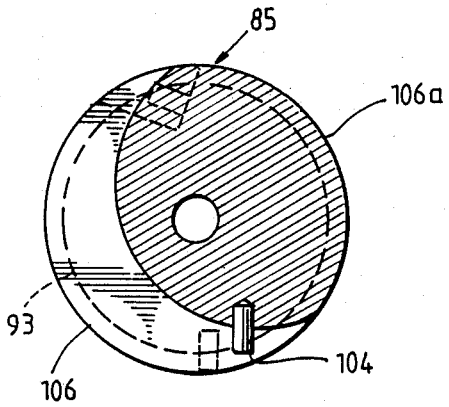
FIG. 11 is a cutaway top view of one of the access window rotors taken along line 11—11 of FIG. 9.

Bias linkage groove 105 may be machined in rotor 84 and bias linkage groove 106 may be machined in rotor 85. The grooves 105 and 106 are off-center radius grooves. The configuration of grooves 105 and 106, in rotors 84 and 85 respectively, are illustrated in FIG. 11. The configuration of grooves 105 and 106 results in the sensation, to a person pushing on operator bar 22, of a uniform resistance as an access window travels from the fully closed to the fully opened position. The uniform resistance, sensed by the person operating the window, is created by closer bias member linkages 102*a* and 102*b* traveling from the outer peripheries 105*a* and 106*a* of rotors 84 and 85 respectively, (with the access window closed) into grooves 105 and 106 of rotors 84 and 85 respectively, as the access window opens. This configuration provides for uniform window closer bias member 101 tension as weather stripping 107 (see FIG. 1) on the common edges of window members 27 and 29 is separated.

Providing a uniform tension on window closer bias member 101 as an access window travels from a fully closed window to a fully opened window is imperative in order to keep the access window from flopping wide open as soon as the weather stripping 107 is separated. Access windows which flop open often startle persons on both sides of the windows.

The use of off-center radius grooves 105 and 106 on rotors 84 and 85 respectively, tends to result in a smooth operating window with equal tension on window closer bias member 101 throughout the complete window cycle, i.e., full closed to full open to full closed.

The use of off-center radius grooves 105 and 106 as disclosed herein tends to create a greater opening torque, for the access window opening cycle, as the window begins to open (when the weather stripping 107 is in contact); then tends to reduce the opening torque when window closer bias links 102*a* and 102*b* enter grooves 105 and 106 respectively (after the weather stripping 107 has separated ).

In a similar fashion for the access closing window cycle the off-center radius grooves 105 and 106 tend to create a lesser torque as the window begins to close (when the weather stripping 107 is separated); then increases the closing torque as the window closes as window closer bias links 102*a* and 102*b* exit grooves 105 and 106 respectively (as the weather stripping 107 comes into contact).

Grooves 105 and 106 also aid in a uniform closing cycle of access window members 27 and 28, as the members travel from full open to full closed.

Another beneficial aspect of the present invention is the locked window bias member 108 and turnbuckle 109 illustrated in FIG. 9. The locked window bias member 108 absorbs pushing action on push-bar 22 in the event the access window members 27 and 28 have been latched by means of latching member 39 (as illustrated in FIG. 1). Locked window bias member 108 absorbs the forces supplied to push-bar 22 without damaging window members 27 and 28, and further without damaging any parts of the window operators and interconnecting linkage 94.

In the event a person pushes on operator bar 22 while the latching bar 39 is installed, the locked window bias member 108 stretches to absorb the pushing motion. Push-bar 22 can be pushed to its travel limit, at which time travel stop 71 comes in contact with vertical wall 70 of horizontal shelf 23 (see FIG. 8). With the latch bar 39 installed, as push-bar 22 is pushed window bias member 108 stretches; however, rotor 85 does not turn. Since rotor 85 does not turn, rotor 84 likewise does not turn. Consequently, window members 27 and 28 remain closed; rotors 84 and 85 remain stationary; and only push-bar 22 flexes inward and locked window bias member 108 stretches. Locked window bias member 108 must be stiff enough, so that it does not stretch during normal window operation and only stretches when the latch bar 39 is installed.

Locked window bias member 108 also tends to cushion a sudden impact to operator bar 22 when operator bar 22 is pushed abruptly with the latch bar 39 not installed. Thus when the window latch member 39 is not installed, bias member 108 tends to serve as an energy storage device, e.g., stores a sudden impact and then uses the stored energy to open the access window.

One end of the locked window bias member 108 is positioned in one of the push-bar bracket 91 holes (91*a*,91*b*, 91*c*, 91*d*, 91*e*, 91*f*). The push-bar bracket holes are provided to permit a field adjustment, once the window has been installed. The adjustment holes permit the installer to achieve full window travel, as the push-bar 22 is pushed from the window closed position to the window open position.

The opposite end of locked window bias member 108 is affixed to one end of a turnbuckle 109. The other end of turnbuckle 109 is attached to nylon string 92. Turnbuckle 109 permits string 92 to be field adjusted to insure a fully closed window when the push-bar 22 is in the "window closed" position.

As can be appreciated by one skilled in the art, the above detailed description describes only one embodiment of the present invention. The window can be readily adapted from an outwardly opening window to an inwardly opening window by merely varying the operation of nylon string 92 on rotors 84 and 85. Various components may be replaced by other mechanical or electromechanical equivalents to accomplish the same result, particularly in view of the interchangeable nature of such devices and their functions in the present invention. Variations and modifications of the invention will become obvious from the drawings and specification. Accordingly, the present invention should be limited only by the scope of the appended claims.

What is claimed is:

1. An access window comprising:

(a) at least one hinged window member;

(b) a segmented operator bar hinged at its outboard ends and articulated between said outboard end; and (c) an adjustable flexible linkage operatively coupling the segmented operator bar to the window member wherein pushing said operator bar causes said window member to swing open.

2. The access window described in claim 1 further wherein said segmented operator bar can be locked to hold said window member in the open position.

3. The access window described in claim 1 wherein said segmented operator bar can be slidably locked to continuously hold said window member in the open position.

4. An access window for installation in business establishments to provide access between a customer and a sales person comprising:

(a) at least one pivoting planar surface hinged at a minimum of two pivot points;

(b) a rotor member operatively coupled to at least one of said pivot points;

(c) a segmented operator bar hinged at its outboard ends and articulated between said outboards ends; and (d) an adjustable flexible linkage operatively coupling said rotor member to said operator bar such that movement of said operator bar causes said planar surface to swing about said pivot points.

5. The access window described in claim 4 including a lock operable when said planar surface is open to continuously hold said planar surface in the open position.

6. The access window described in claim 4 wherein said segmented operator bar can be slidably locked to continuously hold said planar surface in the open position.

7. The access window described in claim 4 further comprising a locked window bias member wherein said bias member is capable of absorbing pushing action on said operator bar in the event said pivoting planar surface is obstructed, thus preventing the planar surface from opening.

8. The access window described in claim 4 further comprising a locked window bias member wherein said bias member stores the initial impact to said operator bar, and subsequently uses said stored initial impact to open said planar surface.

9. An access window for providing access between a customer and a sales person comprising:

(a) two pivoting vertically disposed planar surfaces, each said planar surface hinged at a first pivot point and a second pivot point;

(b) a first hinged post and antifriction member attached at said first pivot point;

(c) a second hinged post antifriction member and rotor attached at said second pivot point;

(d) an adjustable flexible linkage interconnecting the rotors such that the flexible linkage causes said rotors to rotate in opposite direction when either rotor is rotated;

(e) a segmented operator bar hinged at its ouboard ends and articulated between said outboard ends and operatively coupled to at least one of said rotors such that pushing the operator bar causes the coupled rotor to rotate.

10. The access window described in claim 9 including a lock operable to lock said segmented operator bar so as to continuously hold said planar surfaces in the open position.

11. The access window described in claim 9 wherein said segmented operator bar can be slidably locked to continuously hold said planar surfaces in the open position.

12. The access window described in claim 9 further comprising a locked window bias member capable of absorbing pushing action on said operator bar in the event said pivoting planar surfaces are obstructed, thus preventing the planar surfaces from opening.

13. The access window described in claim 9 wherein the operator bar is equipped with hand holds.

14. The access window described in claim 9 wherein each said rotor is equipped with an off-center radius groove, said groove accommodating the flexible linkage which interconnects the rotors with the window closer bias member.

15. The access window described in claim 9 wherein the initial opening torque is greater than the torque at the end of the opening cycle and wherein the initial closing torque is less than the closing torque at the end of the closing cycle.

16. An access window for installation in business establishments to provide access between a customer and a sales person comprising:

(a) at least one pivoting planar surface hinged at a minimum of two pivot points;

(b) an operator bar;

(c) an elastic linkage coupling said operator bar to said planar surface; and (d) a locked window bias member wherein said bias member stores the initial force applied to said operator bar and subsequently uses said stored initial force to open said planar surface.

17. An access window for installation in business establishments for providing access between a customer and a sales person comprising:

(a) at least one pivoting planar surface hinged at least one pivot point;

(b) a rotor attached to said pivoting planar surface wherein said rotor delivers an initial opening torque greater than the torque at the end of the opening cycle and wherein said rotor delivers an initial closing torque less than the closing torque at the end of the closing cycle; and (c) an operator bar operatively coupled to said rotor and acting to turn said rotor and said planar surface when the operator bar is pushed.

* * * * *